US005241766A

United States Patent [19]

Walz et al.

[11] Patent Number: 5,241,766

[45] Date of Patent: Sep. 7, 1993

[54] FOLDABLE PULL-OUT IRONING BOARD

[75] Inventors: Rüdiger Walz, Moetzingen; Georg Häsler, Nagold, both of Fed. Rep. of Germany

[73] Assignee: Hafele GmbH & Co., Nagold, Fed. Rep. of Germany

[21] Appl. No.: 944,514

[22] Filed: Sep. 14, 1992

[30] Foreign Application Priority Data

Sep. 14, 1991 [DE] Fed. Rep. of Germany ... 9111464[U]

[51] Int. Cl.[5] ..... D06F 81/02; A47B 46/00

[52] U.S. Cl. ..... 38/104; 38/139; 108/112; 312/29

[58] Field of Search ..... 38/104, 103, 112, 137, 38/138, 139; 190/11, 13 D, 17; 312/24, 25, 26, 23, 28, 29; 108/12, 17, 39, 108, 63, 93, 112

[56] References Cited

U.S. PATENT DOCUMENTS

| | | | |
|---|---|---|---|
| 912,319 | 2/1909 | Nelson | 38/138 X |
| 1,500,068 | 7/1924 | Goodman | 38/139 X |
| 1,663,449 | 3/1928 | Folz | 38/139 X |
| 1,677,620 | 7/1928 | Cummings | 38/139 |
| 2,101,142 | 12/1937 | Jensen et al. | 38/1 A |
| 2,518,309 | 8/1950 | Gross | 38/104 |
| 2,523,425 | 9/1950 | Gargaglione | 38/112 X |
| 3,732,639 | 5/1973 | Elder | 38/139 |

FOREIGN PATENT DOCUMENTS

| | | | |
|---|---|---|---|
| 3430491 | 2/1986 | Fed. Rep. of Germany | 38/104 |
| 1557875 | 1/1969 | France | 190/17 |
| 2416670 | 10/1979 | France | 108/39 |

*Primary Examiner*—Clifford D. Crowder
*Assistant Examiner*—Ismael Izaguirre
*Attorney, Agent, or Firm*—Cohen, Pontani, Lieberman, Pavane

[57] ABSTRACT

A built-in, pull-out ironing board includes a rear part and a front part which is foldable onto the rear part. The rear part is connected to a pull-out system which is slidably mounted in a guide. The connection of the rear part with the pull-out system is effected through at least one pair of parallelogram-type levers, so that the rear part can be pivoted from a lower position of rest to an upper position of operation. A support member for the front part is longitudinally slidably mounted on the rear part. The pull-out system is connection in an articulated manner through a push arm to the support member. The hinge connection of the push arm to the support member is located in pull-out direction behind the hinge connection of the push arm to the pull-out system.

2 Claims, 3 Drawing Sheets

FOLDABLE PULL-OUT IRONING BOARD

BACKGROUND OF THE INVENTION

1. Field of the Invention

The present invention relates to a built-in, pull-out ironing board. The ironing board includes a front part which can be folded onto a rear part. The rear part is mounted on a pull-out system which is slidably supported in a guide. The rear part can be swung between a lower position of rest and an upper position of operation by means of at least one pair of parallelogram-type levers.

2. Description of the Related Art

In a known built-in ironing board of the above-described type, the folded-down front part is supported by a support member which is pivotally arranged on the front part and engages in a locking mechanism. However, in this known ironing board, there is the possibility that the stirrup of the ironing board does not pivot automatically into the correct position and, therefore, that it is necessary to manually place the stirrup in the correct position. In addition, the support members make it impossible to iron hose-like parts of articles of clothing, such as, arms, legs, etc., because these parts cannot be pulled sufficiently far enough over the ironing board.

SUMMARY OF THE INVENTION

Therefore, it is the object of the present invention to provide an ironing board in which the front part of the ironing board is securely supported and in which the support mechanism of the ironing board can be pulled out and pushed in completely automatically.

In accordance with the present invention, a support member for the front part is longitudinally slidably mounted on the rear part. The pull-out system is connected in an articulated manner to the support member by means of a push arm. A hinged connection of the push arm to the support member is located in pull-out direction behind a hinged connection to the pull-out system.

Accordingly, as a result of the configuration of the ironing board according to the present invention, when the ironing board is pulled out from its pushed-in position and is either automatically or manually moved into its position of operation, the push arm is positively pivoted around its hinge connection at the pull-out system and transmits the horizontal portion of its movement to the support member. Consequently, the support member is pushed forwardly in pull-out direction and forms a continuous support for the front part when the front part is folded into its position of operation. Accordingly, the support system is completely automatically pushed forward when the ironing board is pulled out and is completely automatically moved back when the ironing board is pushed in.

The length of the pull-out movement of the support member can be changed as desired within certain limits by a suitable selection of the hinge connections and the length of the push arm. In addition, the support mechanism ensures that hose-like articles of clothing can be pulled very far onto the ironing board, so that ironing of these articles of clothing has been substantially simplified.

In order to simplify the construction of the entire arrangement, the front lever of the pair of parallelogram-type levers and the push arm have a common hinge connection at the pull-out system. The push arm is advantageously arranged at the rearward free end of the support member.

For additionally securing the front part and the entire ironing board in the position of operation, the support member has a locking projection and the front part has a locking groove or the like which cooperates with the locking projection. Of course, it is also possible to arrange the locking projection on the front part and the locking groove on the support member and other locking mechanisms are also possible.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described a preferred embodiment of the invention.

DESCRIPTION OF THE PREFERRED EMBODIMENT

Figure 1:
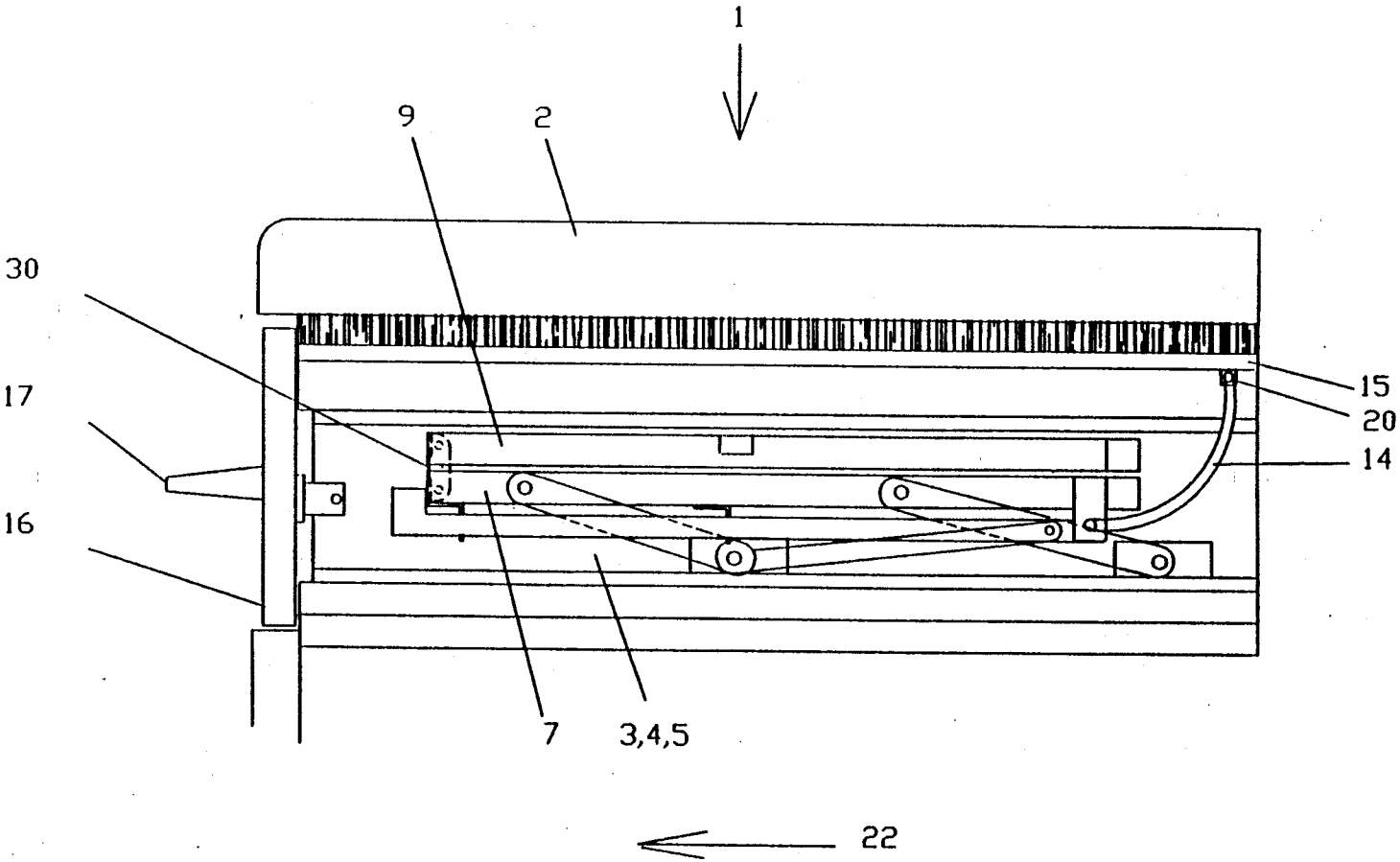
FIG. 1 is a partial side view of an ironing board in the pushed-in state.
Figure 2:
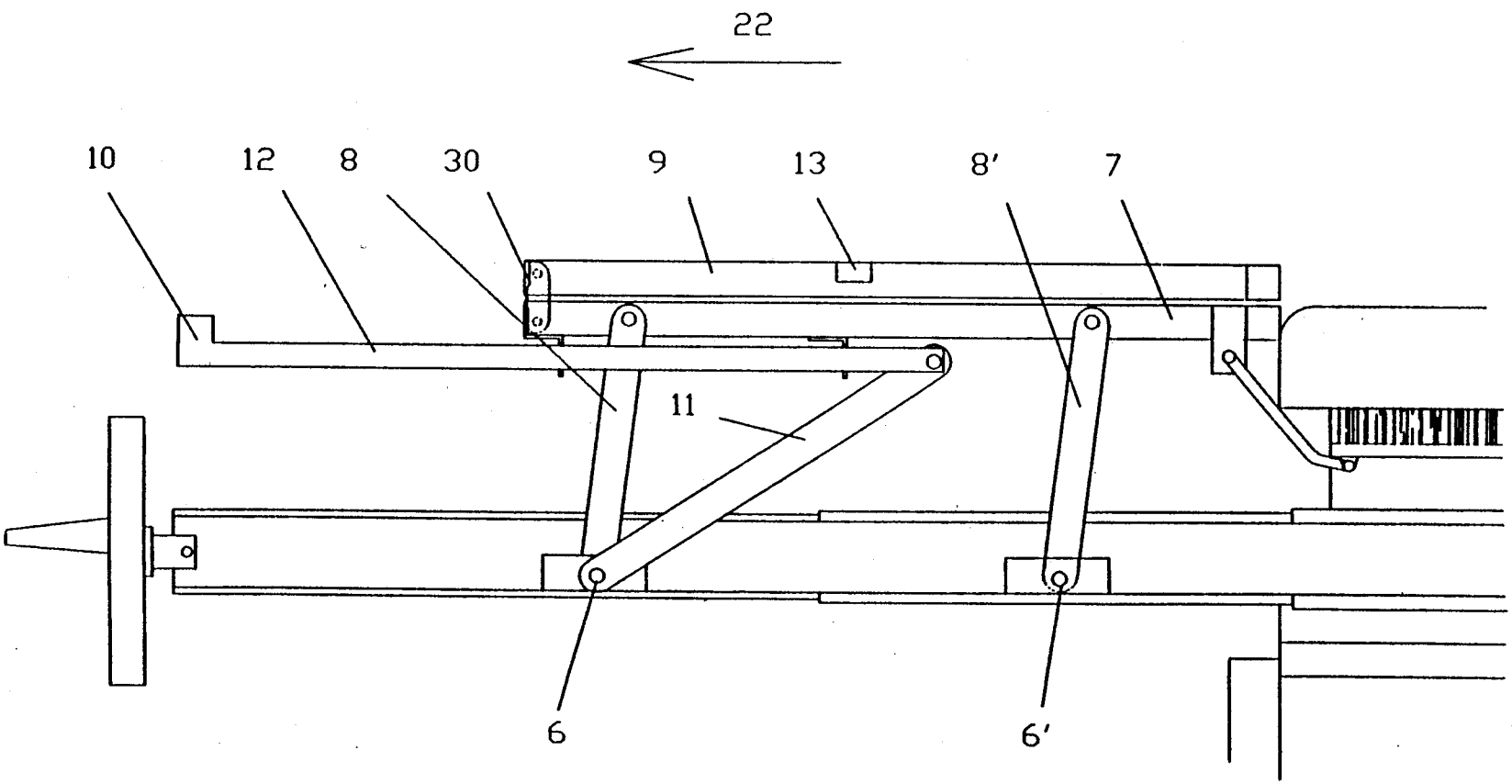
FIG. 2 shows the ironing board of FIG. 1 in the pulled-out state with the front part being folded up.

As illustrated in the drawing, the ironing board is mounted in a drawer located underneath a work plate 2 of a closet 1. The work surface of the ironing board is provided by a rear part 7 and a front part 9, which are connected to each other by means of a hinge 30 so that, as shown in FIGS. 1 and 2, the front part 9 can be folded onto the rear part 7. The folded-together ironing board is covered toward the front by means of a cover 16 with a handle 17 which is used for pulling out the ironing board. Pulling out of the ironing board is effected by means of a pull-out system composed of telescopic rails 3, 4, and 5. A wire rope 14 is connected to the rearward end of the rear part 7. The other end of the wire rope 14 is fastened to an anchor member 20 which is slidable in a rail 15.

Pulling on the handle 17 has the effect that the telescopic rails 3, 4, and 5 are pulled out. Simultaneously, the anchor member 20 of the wire rope 14 in the guide rail 15 is pulled in pull-out direction 22 until the anchor member 20 makes contact at a forward part of the guide rail 15. Subsequently, the wire rope 14 pulls the entire arrangement backwards, so that the parallelogram-type levers 8 and 8' which are pivotally hinged to the rear part 7 are pivoted into an upright position in direction of arrow 25. The parallelogram-type levers 8 and 8' are connected through hinge connections 6 and 6' to the telescopic rails 3 and 4 of the pull-out system.

Finally, the parallelogram-type levers 8 and 8' assume the position shown in FIG. 2. In this position, the rear part 7 rests against the front edge of the work plate 2.

In addition, a support member 12 is slidably mounted on the rear part 7. At its forward end, the support member 12 has a locking projection 10. When the ironing board is pulled out in direction of arrow 22, a push arm 11 fastened to the hinge connection 6 is pivoted in the direction of arrow 26, i.e., opposite to the pivoting movement of the parallelogram-type levers 8 and 8' and pushes forwardly, i.e., in direction of arrow 22, the support member 12 at whose rearward end 28 it is hinged at 27. Although only one push arm 11 is illustrated in the drawing, it is of course possible that also a pair of push arms act on both sides of the support member 12.

Figure 3:
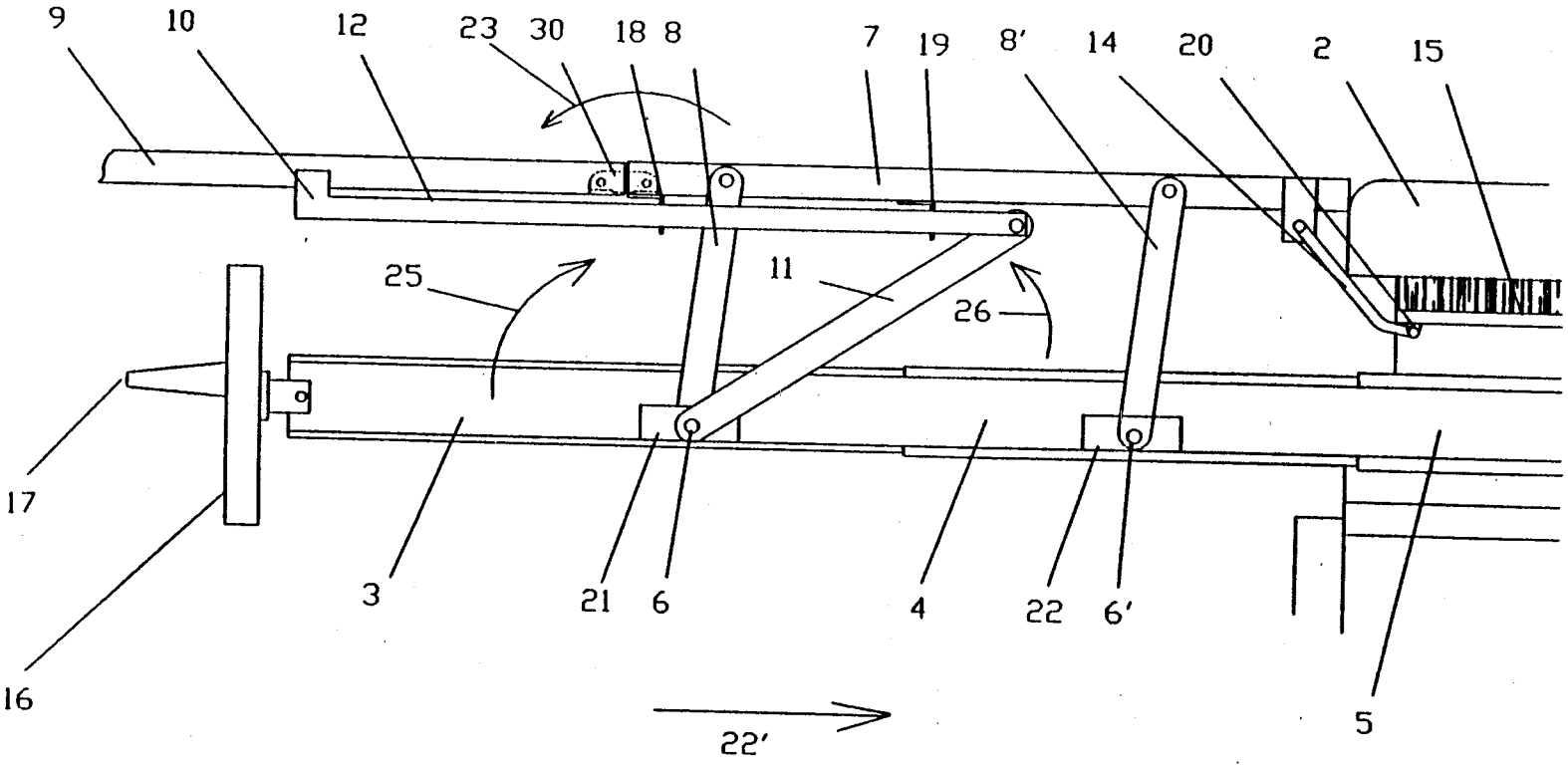
FIG. 3 shows the ironing board as in FIG. 2, except that the front part is folded down.

As illustrated in FIG. 3, the front part 9 is folded forwardly about the hinge 30 in direction of arrow 23 and a locking groove 13 in the front part 9 engages the locking projection 10. As a result, the folded-out front part 9 is held by the support member 12 and the locking projection 10 in a stable and locked position in the same plane as the rear part 7.

When the ironing board is again to be pushed in, starting from the state illustrated in FIG. 3, initially the front part 9 is folded back until it assumes the position shown in FIG. 2. A pressure exerted on the handle 17 in direction of arrow 22' is transmitted through the parallelogram-type levers 8 and 8' to the rear part 7 which synergistically with the pushing in of the telescopic rails is pushed by the front edge of the work plate 2 toward the front, i.e., in the direction of arrow 22. Consequently, the parallelogram-type levers 8 and 8' are pivoted past their upper dead centers and are finally folded back into the position shown in FIG. 1. Simultaneously, the push arm 11 is pivoted downwardly opposite to the arrow 26 of FIG. 2, so that the support member 12 is pushed in direction of arrow 22' as the two ironing board parts 7 and 9 are lowered.

It should be understood that the preferred embodiment and examples described are for illustrative purposes only and are not to be construed as limiting the scope of the present invention which is properly delineated only in the appended claims.

We claim:

1. An ironing board comprising a rear part and a front part foldable onto the rear part, a telescopic pull-out system slidably mounted in a guide means, at least one pair of parallelogram-type levers comprising a front lever and a rear lever for pivotally connecting the rear part to the pull-out system, a support member for supporting the front part mounted on the rear part so as to be slidable relative to the rear part in a longitudinal direction, a push arm having first and second ends, hinge means for connecting the front lever to the pull-out system, the first end of the push arm being hinged to the pull-out system in the hinge means connecting the front lever to the pull-out system, the support member having a rear free end, the second end of the push arm being hinged to the rearward free end of the support member.

2. The ironing board according to claim 1, wherein the support member has a locking projection and the front part has a locking groove for engagement with the locking projection.

* * * * *